US011083057B2

(12) United States Patent
Zijlman et al.

(10) Patent No.: US 11,083,057 B2
(45) Date of Patent: Aug. 3, 2021

(54) LED LIGHTING DRIVER AND DRIVE METHOD

(71) Applicant: SIGNIFY HOLDING B.V., Eindhoven (NL)

(72) Inventors: Theo Gerrit Zijlman, Eindhoven (NL); Bertrang Johan Edward Hontele, Eindhoven (NL); Henricus Marius Joseph Maria Kahlman, Eindhoven (NL); Hannah M. Yang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 15 days.

(21) Appl. No.: 16/496,790

(22) PCT Filed: Mar. 26, 2018

(86) PCT No.: PCT/EP2018/057625
§ 371 (c)(1),
(2) Date: Sep. 23, 2019

(87) PCT Pub. No.: WO2018/184888
PCT Pub. Date: Oct. 11, 2018

(65) Prior Publication Data

US 2020/0383185 A1 Dec. 3, 2020

(30) Foreign Application Priority Data

Apr. 5, 2017 (WO) ..... PCT/CN2017/079477
Jun. 12, 2017 (EP) ..... 17175516

(51) Int. Cl.
*H05B 45/14* (2020.01)
*H05B 45/38* (2020.01)
*H05B 45/375* (2020.01)

(52) U.S. Cl.
CPC ..... *H05B 45/14* (2020.01); *H05B 45/375* (2020.01); *H05B 45/38* (2020.01)

(58) Field of Classification Search
None
See application file for complete search history.

(56) References Cited

U.S. PATENT DOCUMENTS 5,949,197 A * 9/1999 Kastner ..... H05B 41/2851 315/291
5,949,279 A 9/1999 Kwan
8,928,235 B2 * 1/2015 Angeles ..... H05B 45/00 315/200 R (Continued)

FOREIGN PATENT DOCUMENTS

CN 203872386 U 10/2014
CN 103139992 B 8/2015
WO 2015107498 A1 7/2015

*Primary Examiner* — Amy Cohen Johnson
*Assistant Examiner* — Srinivas Sathiraju
(74) *Attorney, Agent, or Firm* — Daniel J. Piotrowski

(57) ABSTRACT

An LED lighting driver has a switched mode power supply which generates an auxiliary power supply. The auxiliary power supply has a dummy load, and a control circuit for controlling the connection of the dummy load in parallel with the auxiliary load in dependence on the current drawn by the auxiliary load. In this way, a current drawn by the auxiliary load is made more stable so that effects of auxiliary supply fluctuations on the light output are reduced.

15 Claims, 3 Drawing Sheets

(56) References Cited

U.S. PATENT DOCUMENTS 9,648,676 B2 * 5/2017 Angeles ..... H05B 45/37
9,699,849 B2 * 7/2017 O'Neil ..... H05B 33/08
10,530,187 B2 * 1/2020 Ikefuji ..... H02J 7/04
2002/0047693 A1 * 4/2002 Chang ..... H02M 1/4208 323/222
2005/0062516 A1 3/2005 Boetzel et al.
2011/0285301 A1 11/2011 Kuang et al.
2012/0056553 A1 * 3/2012 Koolen ..... H05B 45/3575 315/291
2013/0038234 A1 * 2/2013 Van Der Veen ..... H05B 45/37 315/224
2013/0057167 A1 * 3/2013 Angeles ..... H05B 45/37 315/200 R
2013/0113375 A1 * 5/2013 Leung ..... H05B 41/28 315/85
2014/0049189 A1 * 2/2014 Ter Weeme ..... H05B 45/3577 315/296
2014/0077615 A1 * 3/2014 Stevens ..... H02J 7/00302 307/104
2014/0210367 A1 * 7/2014 Zijlman ..... H05B 45/48 315/188
2014/0239829 A1 * 8/2014 Zhang ..... H05B 45/37 315/200 R
2014/0361694 A1 12/2014 Chen et al.
2015/0137704 A1 * 5/2015 Angeles ..... H05B 45/37 315/297
2016/0225562 A1 * 8/2016 Franks ..... H02H 3/08
2016/0226384 A1 * 8/2016 Nishijima ..... H02M 3/33507
2016/0353535 A1 * 12/2016 Arulandu ..... H05B 45/37
2016/0381745 A1 * 12/2016 O'Neil ..... H05B 45/50 315/85
2017/0245341 A1 * 8/2017 Lee ..... H05B 45/50
2019/0230758 A1 * 7/2019 Wang ..... H02J 9/02
2020/0092966 A1 * 3/2020 Zijlman ..... H05B 45/37
2020/0107425 A1 * 4/2020 Zijlman ..... H05B 45/14
2020/0383185 A1 * 12/2020 Zijlman ..... H05B 45/14

* cited by examiner

LED LIGHTING DRIVER AND DRIVE METHOD

CROSS-REFERENCE TO PRIOR APPLICATIONS

This application is the U.S. National Phase application under 35 U.S.C. § 371 of International Application No. PCT/EP2018/057625, filed on Mar. 26, 2018, which claims the benefit of European Patent Application No. 17175516.8, filed on Jun. 12, 2017, and Chinese Patent Application No. PCT/CN2017/079477, filed on Apr. 5, 2017. These applications are hereby incorporated by reference herein.

FIELD OF THE INVENTION

This invention relates to LED lighting, and in particular to an LED lighting driver.

BACKGROUND OF THE INVENTION

Solid state lighting units, and in particular LED-based (retrofit) lamps, are used more and more in home buildings and offices. Besides their high efficiency they also attract consumers due to new design features, different color temperatures, dimming ability etc.

To fit LED lighting to existing mains lighting fixtures, each LED light unit makes use of a converter circuit, for converting the AC mains into a DC drive signal, and also for reducing the voltage level.

The converter circuit typically comprises a rectifier and a switched mode power converter.

There are various possible designs of switched mode power converter. A low cost switched mode power converter is a single stage converter, such as a buck converter or a buck-boost converter. In both cases, there is a main inductor which controls the delivery of energy to the load. A main power switch controls the supply of energy from the input to the main inductor.

The timing of operation of the main power switch, in particular the duty cycle, controls the energy transfer. A ringing choke converter (RCC) is a typical self-oscillation converter in which the cyclic operation of the switching is self-controlled, and is widely used as a low cost LED driver. Alternatively, an IC-based converter has control of the main power switch using an IC. This IC may then implement additional functionality, such as dimming control.

There is a desire to reduce the size or number of components within the driver circuit, since there is limited PCB space within an LED light unit, as well as to reduce cost. For a dimmable LED, local control circuitry is also needed.

To reduce the costs of a dimmable solution, integration of an auxiliary power supply with the already-needed switched mode power converter has been proposed. An auxiliary power supply can be generated using a flyback auxiliary supply.

Because the dynamic current consumption of the auxiliary components, such as the microcontroller unit (MCU) of the circuit, is not known in advance, lighting flicker may result from variations in the current drawn by the auxiliary power supply, which is particularly visible at low lighting levels. This is an issue especially for a single stage, single string implementation of an LED current source and driver, when an auxiliary supply is integrated into the driver.

SUMMARY OF THE INVENTION

The invention is defined by the claims.

According to examples in accordance with an aspect of the invention, there is provided an LED lighting driver comprising:

- a switched mode power supply having a main energy storage inductor for delivering energy to an LED lighting load; and
- an auxiliary power supply circuit comprising a power supply inductor magnetically coupled to the main energy storage inductor and a rectifier diode for delivering a rectified voltage to an auxiliary load, wherein the auxiliary power supply circuit comprises:

- a dummy load;
- a control circuit for controlling the connection of the dummy load in parallel with the auxiliary load;
- a current sense circuit for sensing a current drawn by the auxiliary load and controlling the control circuit in dependence on the current drawn, This driver controls a lighting load as well as generating an auxiliary supply. In order to reduce the impact of auxiliary supply demands on the power delivered to the lighting load, a dummy load is used. In particular, it may enable the current draw by the auxiliary load and the dummy load in combination to be kept near constant. In this way, flicker of the lighting load output that may be caused by fluctuating demands of the auxiliary supply is prevented.

The control circuit for example comprises a transistor and a controllable voltage reference, such as a gated diode, for controlling the pulling of the gate of the transistor to a reference potential thereby to turn it off. If the transistor is turned on, a current is driven through the dummy load, thus increasing the current drawn by the full auxiliary supply. If the transistor is turned off, current is not driven through the dummy load. The dummy load is in series with the collector-emitter channel (or source-drain channel) of the transistor. Note that a transistor circuit may be used instead of a single transistor.

A dummy load disable circuit may be provided for disabling the dummy load control circuit. This may be used to prevent the power consumption associated with the dummy load when flicker is not an issue. For example, the dummy load disable circuit may be adapted to disable the control circuit in a stand-by mode, or when a drive level of the LED lighting load exceeds a threshold. When in standby mode, flicker is not an issue. Similarly, when the lighting load is driven to a sufficiently bright level, flicker becomes imperceptible.

The dummy load disable circuit is preferably adapted to enable the control circuit when a drive level of the LED lighting load is below the threshold. This is when there is an issue of flicker caused by fluctuating current demands to the auxiliary supply.

The dummy load disable circuit may be adapted to disable the control circuit by an amount which depends on the amount by which the drive level of the LED lighting load exceeds the threshold. Thus, the disabling of the use of the dummy load may be implemented gradually as a function of the lighting level rather than abruptly at one lighting level.

The switched mode power supply for example comprises a single stage buck converter or a single stage buck-boost converter. The switched mode power supply for example comprises a non-isolated converter. These are low cost, and hence low performance drivers, for which flicker may be an issue as a result of a non-perfect decoupling between an auxiliary power supply and the main circuit load.

The invention also provides an LED lighting circuit comprising:

a driver as defined above;

an LED lighting load driven by the driver; and an auxiliary load driven by the auxiliary power supply circuit.

The auxiliary load may be a microcontroller unit (MCU) which implements dimming functionality. It may be an IC which also controls the main switch of the switched mode power supply.

The invention also provides an LED lighting method comprising:

delivering energy to an LED lighting load using a switched mode power supply having a main energy storage inductor;

generating an auxiliary power supply using a power supply inductor magnetically coupled to the main energy storage inductor and a rectifier diode, and supplying the auxiliary power supply to an auxiliary load; and controlling the connection of a dummy load in parallel with the auxiliary load in dependence on a current drawn by the auxiliary load.

The dummy load control may be enabled when a drive level of the LED lighting load is below a threshold and it may be disabled when in a stand-by mode or when a drive level of the LED lighting load exceeds the threshold. Disabling the dummy load control may be by an amount which depends on the amount by which the drive level of the LED lighting load exceeds the threshold.

Delivering energy to the LED lighting load may comprise using a single stage non-isolated buck converter or single stage non-isolated buck-boost converter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides an LED lighting driver having a switched mode power supply which generates an auxiliary power supply. The auxiliary power supply has a dummy load, and a control circuit for controlling the connection of the dummy load in parallel with the auxiliary load in dependence on the current drawn by the auxiliary load. In this way, a current drawn by the auxiliary load is made more stable so that effects of auxiliary supply demand fluctuations on the light output are reduced.

The invention is of particular interest for low cost switched mode power supplies, for which a buck converter and a buck-boost converter are the most common examples.

Figure 1:
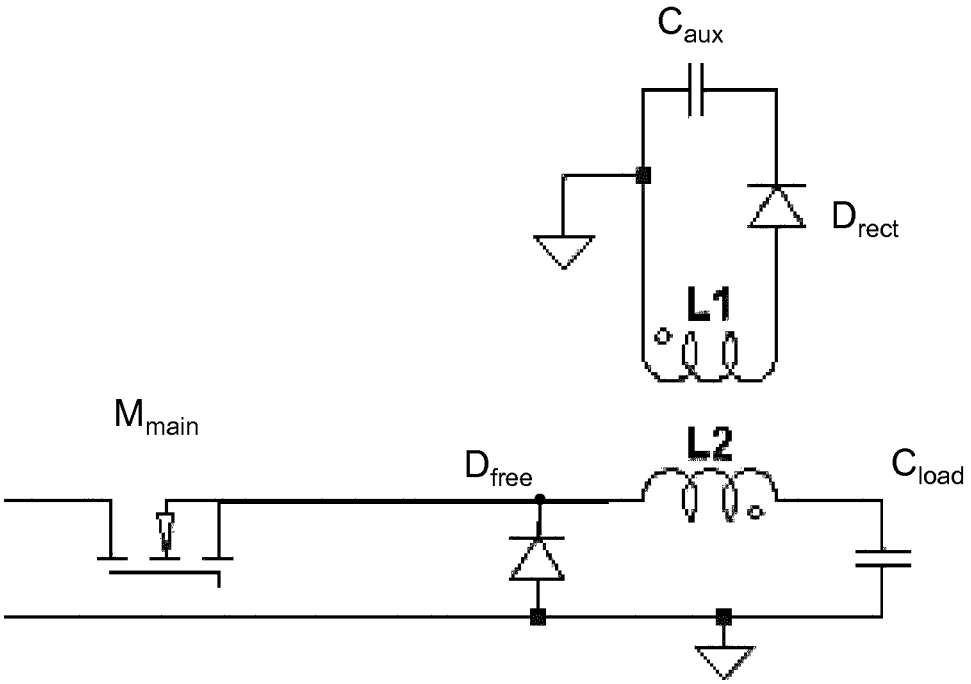
FIG. 1 shows the layout of a standard single stage non-isolated buck converter.

FIG. 1 shows a buck converter (a step-down converter) having an inductor L2 as the primary energy storage element.

The buck converter has the current in the inductor L2 controlled by two switches, a main power switch in the form of a transistor $M_{main}$ and a freewheeling diode $D_{free}$. The load of the circuit is represented by the capacitor $C_{load}$. The main power switch, inductor and load are in series, and the freewheeling diode $D_{free}$ is connected in parallel across the series combination of the inductor and load.

In the transistor open state, the current in the circuit is initially zero. When the transistor is first turned on, the current will begin to increase, and the inductor will produce an opposing voltage across its terminals in response to the changing current. This voltage drop counteracts the voltage at the input and therefore reduces the net voltage across the load. Over time, the rate of change of current decreases, and the voltage across the inductor also then decreases, increasing the voltage at the load. During this time, the inductor stores energy in the form of a magnetic field. The transistor is opened while the current is still changing, so that there is always a voltage drop across the inductor, and the net voltage at the load will always be less than the input voltage source.

The inductor functions alternately as a current source to the load and a current sink from the input.

FIG. 1 shows that the main inductor L2 can also be used to generate an auxiliary power supply. As shown, the auxiliary power supply comprises an inductor L1 magnetically coupled to the main inductor L2, and a rectifier diode $D_{rect}$. This delivers a rectified auxiliary power supply to an auxiliary load, represented by capacitor $C_{aux}$.

In the case of a lighting circuit, the main load $C_{load}$ is the LED lighting and the auxiliary load $C_{aux}$ may be a controller for example for controlling the timing of operation of the main switch $M_{main}$. This controller for example implements dimming functionality.

The current drawn from the auxiliary power supply may vary over time, for example depending on the tasks being performed by the auxiliary load. This alters the energy transfer from the main inductor L2 to the load $C_{load}$, and in the case of a lighting load this may introduce undesired modulation of the light output.

A first aspect of the invention is to provide a mechanism to ensure that the auxiliary supply has a more constant power demand. A second aspect is to carry out this function in a way which has a reduced impact on the efficiency of the system.

Figure 2:
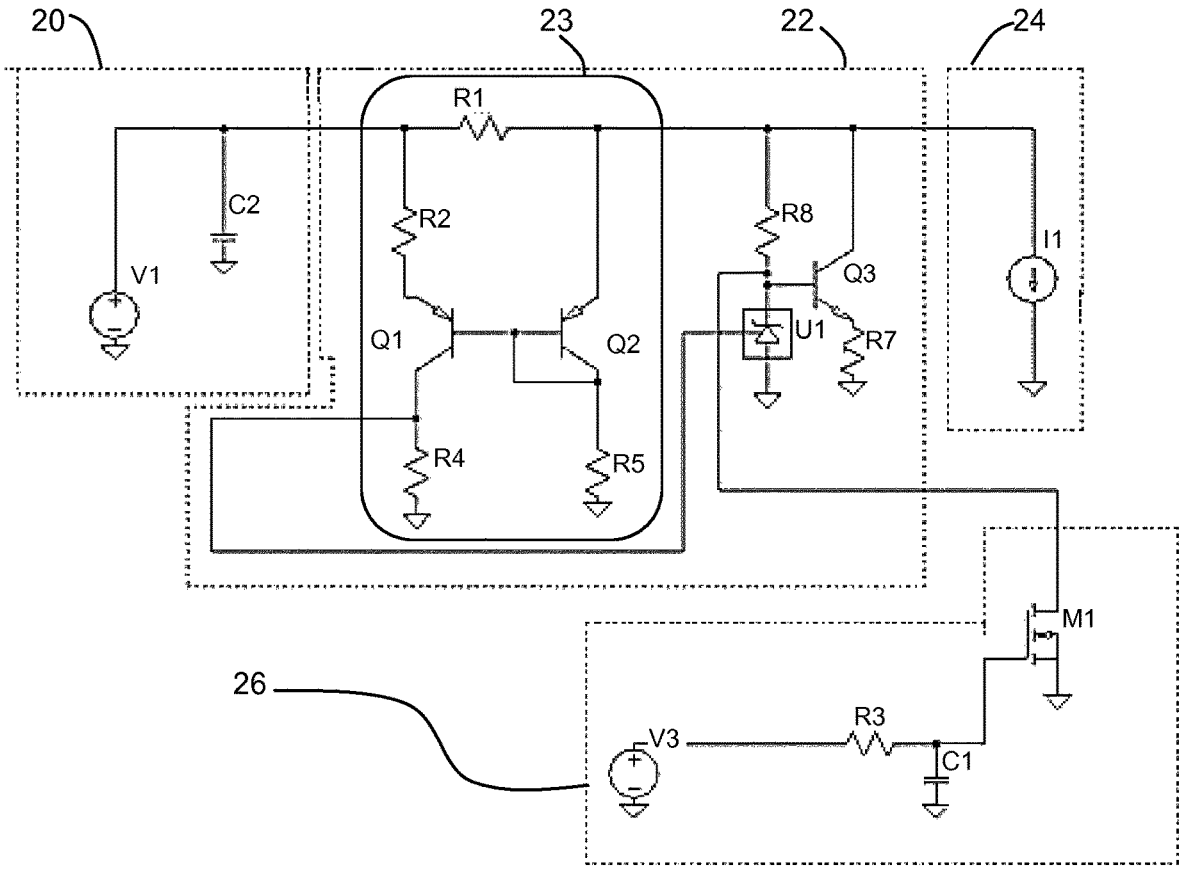
FIG. 2 shows a circuit in accordance with the invention associated with the auxiliary power supply.

FIG. 2 shows a lighting system in accordance with the invention.

The auxiliary supply is represented by block 20, as a voltage source V1 and an output capacitor C2. This voltage source is obtained by inductive coupling from the main inductor of the switched mode power supply, which may typically be a buck converter or a buck-boost converter. However, other inductor-based switched mode power supplies may also be employed to generate an auxiliary supply. The invention is of particular interest for low cost and low component count circuits, since these will in particular suffer from the problem that there is coupling between the auxiliary power supply and the power delivered to the main load. Thus, the invention is of particular benefit for non-isolated switched mode power supplies (by which is meant there is no output transformer) and in particular single stage power supplies (by which is meant there is no separate power factor correction circuit or separate auxiliary power supply circuit, for example). A single stage power supply may integrate other functions such as the dimming capability.

The auxiliary load is represented by block 24 as a current source I1 which represents the current drawn by the auxiliary load, such as a microcontroller unit (MCU) and a low drop out voltage regulator.

The initial auxiliary supply 20 is provided to an auxiliary power supply circuit 22 which is between the initial auxiliary supply 20 and the auxiliary load 24. The circuit 22 comprises a dummy load R7 which is used to dissipate energy in a controlled manner, so that the total energy demand, in particular the current demand, of the circuit is made more constant.

The dummy load comprises a resistor R7 connected in parallel with the auxiliary load I1. The current driven through the dummy load R7 is controlled by a series-connected transistor Q3. The transistor Q3 thus functions as a control circuit for controlling the connection of the dummy load in parallel with the auxiliary load.

The base of the transistor Q3 is connected to the auxiliary supply voltage through a base resistor R8, which, on its own, would turn on the transistor Q3 all the time.

The circuit further comprises a current sense circuit 23 for sensing a current drawn by the auxiliary load and controlling the switching of the transistor Q3 in dependence on the current drawn.

The current sense circuit 23 provides a control voltage to a controllable voltage reference U1, in particular a gated diode in the example shown. The controllable voltage reference U1 is able to pull low the base of transistor Q3, thereby turning it off and preventing current being drawn through the dummy load R7. Thus, it controls the gate voltage on transistor Q3 relative to ground. It provides a controllable conduction path to ground. In this way, instead of current being drawn through the dummy load R7, current instead is drawn through the base resistor R8 and the controllable voltage reference U1. The base resistor R8 has much higher resistance (e.g. 15 kOhms) than the dummy load (e.g. 100 Ohms) and thus consumes negligible power.

The current sense circuit 23 comprises an unbalanced current mirror configuration with two branches (a first branch is resistors R2, R4 and transistor Q1 and a second branch is resistor R5 and transistor Q2). A resistor R1 between the top of the branches functions as a current sense resistor. The current drawn by the auxiliary load passes through the resistor R1 which has low resistance and hence consumes negligible power (e.g. 18 Ohms).

The value of resistor R1 is selected to define a nominal current level of the auxiliary power supply, which may correspond to a maximum expected output current. If the current is below this maximum, the output voltage from the current sense circuit falls. This output is provided to the controllable voltage reference U1 and the pulling down of the base of transistor Q3 is reduced, hence allowing the transistor to be turned on through its base resistor R8.

The circuit provides analog control. The feedback connection of the current sense signal serves to regulate the total current to the nominal level, by drawing a controlled amount of additional current through the dummy load R7. In this way, the total current is kept constant.

In this way, the impact of the auxiliary supply on the power delivered to the lighting load is reduced by the dummy load. Thus, flicker of the lighting load output that may be caused by fluctuating demands of the auxiliary supply is prevented.

One problem with this approach is that there is increased power consumption by using the dummy load. Depending on the application, this additional power consumption should be kept to a minimum. The increase in power consumption may be tolerable when noticeable flicker is being avoided. However, there may also be times when flicker is not an issue and the increase in power consumption is not justified.

FIG. 2 shows a dummy load disable circuit 26. This is able to disable the dummy load control circuit 22 by pulling down the base of the transistor Q3 independently of the control implemented by the current sense circuit 23.

This may be used to prevent the power consumption associated with the dummy load when flicker is not an issue. The dummy load disable circuit comprises a pull down transistor M1, and voltage source V3 for controlling the gate of the transistor M1 through a gate resistor R3 and a gate capacitor C1.

When the transistor M1 is turned on, the base of transistor Q3 is pulled to ground, turning it off The disable circuit 26 and the controllable voltage reference U1 are essentially connected in an OR configuration so that either one can isolate the dummy load R7 by turning off the transistor Q3.

The dummy load disable circuit 26 may be adapted to disable the control circuit in a stand-by mode, or when a drive level of the LED lighting load exceeds a threshold. When in standby mode, flicker is not an issue. Similarly, when the lighting load is driven to a sufficiently bright level, flicker becomes imperceptible. Thus, the voltage source V3 delivers a high voltage in these situations.

The dummy load disable circuit is adapted to enable the dummy load function of the control circuit 22 when a drive level of the LED lighting load is below the threshold. During this time, the voltage source V3 delivers a low voltage. This is when there is an issue of flicker caused by fluctuating current demands to the auxiliary supply.

The dummy load disable circuit 26 may function in a binary manner, or it may function in an analog manner. In the analog case, the control circuit 22 is disabled by an amount which depends on the amount by which the drive level of the LED lighting load exceeds the threshold.

The difference between a threshold level and the actual drive level then becomes a control parameter. When the drive level is at or below the threshold, the dummy load function is enabled. When the drive level is above the threshold, the control parameter determines the amount by which the transistor Q3 is turned on/off in an analog manner, which then controls the current flowing to the dummy load R7.

The function between the control parameter and the drive level applied to the base of the transistor Q3 may be linear or non-linear. The dummy load may be fully disabled (i.e. transistor Q3 turned off fully) before the drive level reaches its maximum level, for example at a second threshold. Thus, the transition between the dummy load being active and inactive may take place between two threshold levels. Any suitable function may be used to determine the relationship between brightness level and dummy load utilization.

Thus, the disabling of the use of the dummy load may be implemented gradually as a function of the lighting level rather than abruptly at one lighting level.

For example, as the transistor M1 is gradually turned on, it presents an increasing leakage path for current from the base of the transistor Q3, thereby gradually turning the transistor Q3 off, and hence controlling the current through the dummy load R7 in an analog manner. The gate of the transistor M1 may be controlled by a pulse width modulated signal, which is then smoothed by the gate capacitor C1. Thus, an essentially digital control signal at the gate of the transistor M1 may be used to implement analog control of the conduction of the transistor Q3.

The dummy load disable circuit enables an improved trade-off between efficiency and low end level flicker performance.

By way of example, if the set dimming level corresponds to greater than 50% light level (which functions as a control threshold) the dummy load circuit is switched off gradually via the control signal V3. During dimming (at below the threshold 50% light level) the circuit is switched on.

The lighting load $C_{load}$ comprises an LED lighting load, and it may comprise a single string of LEDs, or it may comprise a more complicated network of series and/or parallel LEDs.

Figure 3:
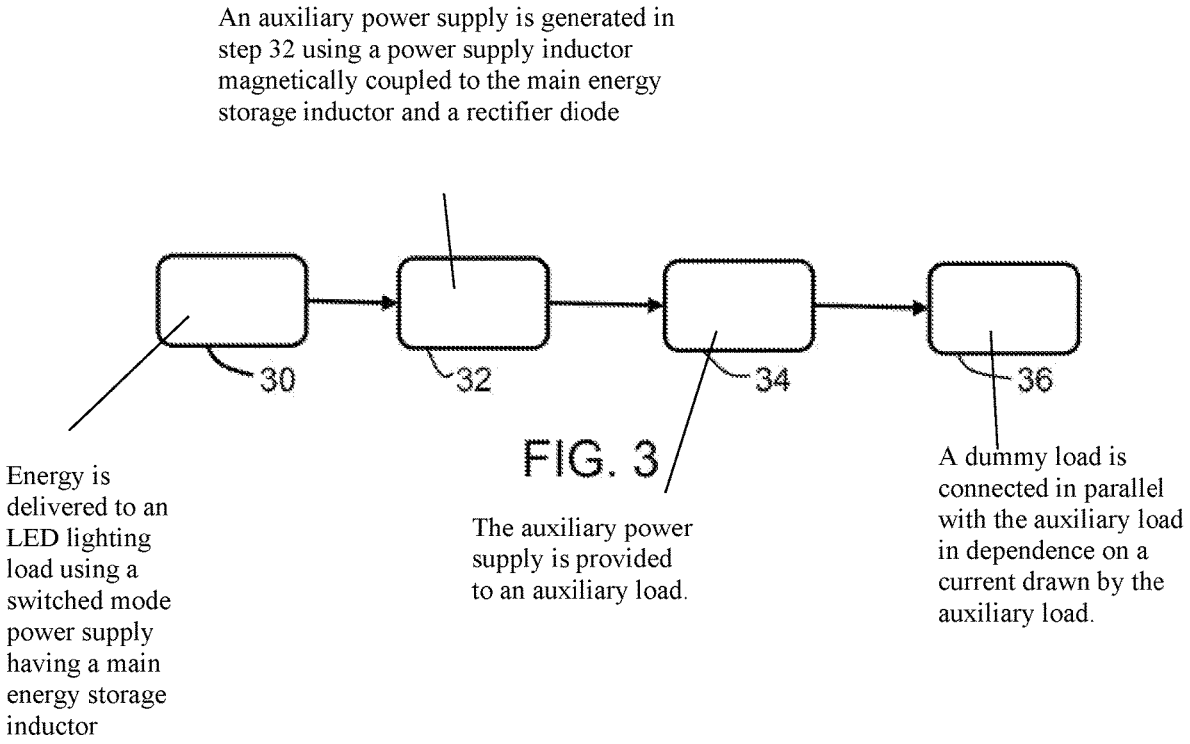
FIG. 3 shows an LED lighting drive method in accordance with the invention.

FIG. 3 shows the method by which the circuit of FIG. 2 operates.

In step 30 energy is delivered to an LED lighting load using a switched mode power supply having a main energy storage inductor.

An auxiliary power supply is generated in step 32 using a power supply inductor magnetically coupled to the main energy storage inductor and a rectifier diode.

In step 34, the auxiliary power supply is provided to an auxiliary load.

In step 36, a dummy load is connected in parallel with the auxiliary load in dependence on a current drawn by the auxiliary load.

The invention is of interest for lighting systems with integrated power architectures. Of most interest is single stage, single string LED lighting approaches with an integrated microcontroller using an auxiliary supply, especially for low cost connected lamps.

Only one example of dummy load control circuit and dummy load disable circuit are shown above. However, the same core functionality may be implemented in different ways. For example, any suitable current sense circuit may be used to generate a control signal which is a function of the sensed load current flowing. More complicated dummy load drive circuits than the simple single drive transistor Q3 may also be used, and the dummy load itself may be any lossy component not limited to a resistor. The controllable voltage reference used to pull down the transistor gate may be implemented as a gated diode, a controllable shunt regulator, or other transistor circuit.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An LED lighting driver comprising:

a switched mode power supply having a main energy storage inductor for delivering energy to an LED lighting load; and an auxiliary power supply circuit comprising a power supply inductor magnetically coupled to the main energy storage inductor and a rectifier diode for delivering a rectified voltage to an auxiliary load, wherein the auxiliary power supply circuit comprises:

the auxiliary load;

a dummy load coupled in parallel with the auxiliary load;

a control circuit for controlling the connection of the dummy load in parallel with the auxiliary load; and a current sense circuit for sensing a current drawn by the auxiliary load and controlling the control circuit in dependence on the current drawn such that a current drawn by the auxiliary load and the dummy load in combination is kept near constant.

2. The LED lighting driver as claimed in claim 1, wherein the control circuit comprises a transistor and a controllable voltage reference for controlling the pulling of the gate of the transistor to a reference potential thereby to turn it off.

3. The LED lighting driver as claimed in claim 1, further comprising a dummy load disable circuit for disabling the dummy load control circuit.

4. The LED lighting driver as claimed in claim 3, wherein the dummy load disable circuit is adapted to disable the control circuit in a stand-by mode.

5. The LED lighting driver as claimed in claim 4, wherein the dummy load disable circuit is adapted to disable the control circuit when a drive level of the LED lighting load exceeds a threshold.

6. The LED lighting driver as claimed in claim 5, wherein the dummy load disable circuit is adapted to enable the control circuit when a drive level of the LED lighting load is below the threshold.

7. The LED lighting driver as claimed in claim 5, wherein the dummy load disable circuit is adapted to disable the control circuit by an amount which depends on the amount by which the drive level of the LED lighting load exceeds the threshold.

8. The LED lighting driver as claimed in claim 1, wherein the switched mode power supply comprises a single stage buck converter or a single stage buck-boost converter.

9. The LED lighting driver as claimed in claim 1, wherein the switched mode power supply comprises a non-isolated converter.

10. An LED lighting circuit comprising:

a driver as claimed in claim 1;

an LED lighting load driven by the driver; and an auxiliary load driven by the auxiliary power supply circuit.

11. The LED lighting method as claimed in claim 10, wherein delivering energy to an LED lighting load comprises using a single stage non-isolated buck converter or single stage non-isolated buck-boost converter.

12. An LED lighting method comprising:

delivering energy to an LED lighting load using a switched mode power supply having a main energy storage inductor;

generating an auxiliary power supply using a power supply inductor magnetically coupled to the main energy storage inductor and a rectifier diode, and supplying the auxiliary power supply to an auxiliary load; and controlling the connection of a dummy load in parallel with the auxiliary load in dependence on a current drawn by the auxiliary load such that a current drawn by the auxiliary load and the dummy load in combination is kept near constant.

13. The LED lighting method as claimed in claim 12, comprising enabling the dummy load control when a drive level of the LED lighting load is below a threshold.

14. The LED lighting method as claimed in claim 13, further comprising disabling the dummy load control when in a stand-by model or when a drive level of the LED lighting load exceeds the threshold.

15. The LED lighting method as claimed in claim 14, comprising disabling the dummy load control by an amount which depends on the amount by which the drive level of the LED lighting load exceeds the threshold.

* * * * *